US008398175B2

(12) United States Patent
Spathis et al.

(10) Patent No.: US 8,398,175 B2
(45) Date of Patent: Mar. 19, 2013

(54) USE OF POST-BLAST MARKERS IN THE MINING OF MINERAL DEPOSITS

(75) Inventors: Alexander Theofile Spathis, Melbourne (AU); Peter Conran Dare-Bryan, Melbourne (AU); Rodney Wayne Appleby, Melbourne (AU); Richard John Goodridge, Melbourne (AU)

(73) Assignee: Orica Explosives Technology Pty Ltd, Melbourne (AU)

( * ) Notice: Subject to any disclaimer, the term of this patent is extended or adjusted under 35 U.S.C. 154(b) by 499 days.

(21) Appl. No.: 12/451,663

(22) PCT Filed: May 26, 2008

(86) PCT No.: PCT/AU2008/000739

§ 371 (c)(1),
(2), (4) Date: Apr. 21, 2010

(87) PCT Pub. No.: WO2008/144811

PCT Pub. Date: Dec. 4, 2008

(65) Prior Publication Data

US 2010/0225155 A1 Sep. 9, 2010

(30) Foreign Application Priority Data

May 25, 2007 (AU) ..... 2007902800

(51) Int. Cl.
*F42D 1/00* (2006.01)

(52) U.S. Cl. ..... 299/1.05; 299/13; 102/301

(58) Field of Classification Search ..... 299/1.05, 299/13; 102/301, 311, 312, 313
See application file for complete search history.

(56) References Cited

U.S. PATENT DOCUMENTS

| | | | | |
|---|---|---|---|---|
| 4,976,199 | A * | 12/1990 | Beukes et al. | 102/200 |
| 6,084,413 | A | 7/2000 | Mohamed | |
| 7,367,269 | B2 * | 5/2008 | La Rosa et al. | 102/301 |
| 7,650,841 | B2 * | 1/2010 | McClure et al. | 102/311 |
| 2006/0170423 | A1 | 8/2006 | Kohgo et al. | |
| 2007/0151471 | A1 * | 7/2007 | La Rosa et al. | 102/301 |
| 2010/0116165 | A1 * | 5/2010 | Moore | 102/311 |

FOREIGN PATENT DOCUMENTS

| | | |
|---|---|---|
| AU | 2004202247 | 12/2004 |
| WO | 2006/119561 | 11/2006 |

OTHER PUBLICATIONS

International Search Report for PCT/AU2008/000739, mailed Jun. 27, 2008.
Written Opinion for PCT/AU2008/000739, mailed Apr. 15, 2009.
International Preliminary Report on Patentability for PCT/AU2008/000739, mailed Mar. 25, 2009.
Thornton et al., "Measuring Blast Movement to Reduce Ore Loss and Dilution", International Society of Explosives Engineers, (2005) vol. 2, 2005, 11 pages.
Derwent Abstract Accession No. J9384A/45, class Q49 SU 585287 A (Yarygin B E) Dec. 18, 1977.
Derwent Abstract Accession No. 87-128248/18, class S03 SU 1257597 A (Don Ore Mining Res) Sep. 15, 1986.
Taylor et al., "Utilization of Blast Movement Measurements in Grade Control", Application of Computers and Operations Research in the Minerals Industries, South African Institute of Mining and Metallurgy, 2003.
Hersey, "New Technology for Smarter Blasting", CIM Magazine vol. 2, Mar./Apr. 2007, 2 pages.
Firth et al., "Blast Movement Measurement for Grade Control", Department of Mining Engineering, Mackay School of Mines University of Nevada, pp. 1-13, 2002.
Harris et al., "The Development and Testing of a non-invasive subsurface Blast Movement Measurement Technique for Surface Mines" 23rd ISEE Ann. Blasting Conf., Las Vegas, Feb. 3-5 1997.
Horocek et al., "Detection of Plastic Explosives" Proc. 27th ISEE Ann. Blasting Conf., Orlando, Jan. 29-31, 2001.

* cited by examiner

*Primary Examiner* — John Kreck
(74) *Attorney, Agent, or Firm* — Nixon & Vanderhye PC

(57) ABSTRACT

A method of mining a mineral deposit includes setting a plurality of explosive charges at spaced pre-blast locations in the deposit, wherein at least selected pre-blast locations also carry respective markers that are such that the post-blast location of at least a useful proportion will be detectable after explosion of the charges. After the charges are exploded to fragment the deposit, the post-blast locations of certain of the markers are detected to obtain an indication of the relative positions of selected components of the mineral deposit after the fragmentation of the deposit by the exploding of the charges. Also disclosed is a method utilizing a plurality of markers arranged to emit a detectable signal after blast fragmentation, and detecting the post-blast locations by triangulation techniques employing a plurality of receiver detectors. A further aspect proposes the use of secondary explosive charges as post-blast markers.

24 Claims, No Drawings

USE OF POST-BLAST MARKERS IN THE MINING OF MINERAL DEPOSITS

This application is the U.S. national phase of International Application No. PCT/AU2008/000739, filed 26 May 2008, which designated the U.S. and claims priority to Australian Application No. 2007902800, filed 25 May 2007, the entire contents of each of which are hereby incorporated by reference.

FIELD OF THE INVENTION

This invention relates generally to the mining of mineral deposits and is concerned in particular with the post-blast determination of the location or other characterisation of components of a fragmented deposit. In an advantageous application, the invention is utilised to determine post-blast ore/waste boundaries.

BACKGROUND OF THE INVENTION

The identification of ore/waste boundaries is a common, and, usually necessary, part of recovering valuable minerals as part of the mining process. It serves two primary purposes: firstly, it ensures that ore loss is minimised at the excavation stage; secondly, it ensures that the treatment of waste is minimised in the post-mining recovery stage. Of course, the initial stage of blasting is designed to minimise mixing between the two components (ore and waste) and reduce ore body sterilisation.

The issue is tackled on a daily basis at all mine operations globally. Simple calculations indicate significant impact on mine profitability but the actual tracking of these ore/waste boundaries is difficult and time-consuming. Mines often accept a level of ore loss and factor this into their financial analyses and predictions.

Current methods for tracking these boundaries usually involve a grid of assay data, often obtained from each blast hole, although the scale of the boundaries and the ore-body geology influence the nature of the assaying demands. Physical targets have been used to track the boundaries after blasting. These targets include visual markers such as PVC pipes installed in extra boreholes within and along the boundaries, or coloured sandbags; magnetic metal targets such as metal balls, chains and the like that are picked up using simple metal detectors. Nuclear markers have also been proposed.

The most attractive techniques are those that enable the excavator operator to make decisions at the time of digging based on whether the current dipper load is ore and is meant for the mill or whether it is waste and is meant for the waste dump. None of the approaches described above have this benefit. In some mines a spotter is required to assist the operator to make that decision—a further, albeit small, cost impost on the operation.

A recent technique is the use of self-righting radio transmitters placed within witness boreholes along the ore-waste boundary, discussed in Australian patent application 2004202247 and in a related paper by Thornton et al "Measuring Blast Movement to Reduce Ore Loss and Dilution", *International Society of Explosives Engineers,* 2005*G, Vol.* 2, 2005. An antenna is walked across the post-blast muckpile and the radio transmitters are detected by their signal strength. The method works well but is not well integrated into the normal mine activities.

A somewhat similar technique, described in Firth, I R et al (2002), 'Blast movement measurement for grade control', Proc. 28th ISEE Annual Blasting Conference, Las Vegas, February 10-13, utilises square section magnetic targets attached at the end of a steel section of 300 mm length. A magnetometer is walked across the post-blast rock and peaks in the signal are detected. The targets give an accuracy of about 0.6 m in the horizontal plane. Reference is also made to a paper by Taylor et al "Utilisation of blast movement measurements in grade control", *Application of Computers and Operations Research in the Minerals Industries*, South African Institute of Mining & Metallergy, 2003, 243-247. This paper outlines a method for delivering data post-blast from an array of magnetic targets.

It is to be understood that any reference herein to prior utilised or disclosed techniques is not to be taken as an admission that those techniques constitute part of the common general knowledge, whether in Australia or elsewhere.

It is an object of the invention to provide one or more methods of mining mineral deposits that include aspects adaptable to facilitate post-blast boundary location or other characterisation of a deposit.

SUMMARY OF THE INVENTION

Respective aspects of the invention are directed to a variety of concepts that each constitute a useful advance over past practice or past proposals, but may be beneficially used together in different combinations according to the circumstances applicable.

A first aspect of the invention proposes the association of explosive charge locations with markers that are such that at least a useful proportion will survive explosion of the charges.

Accordingly, in its first aspect, the invention provides a method of mining a mineral deposit, including:

- setting a plurality of explosive charges at spaced pre-blast locations in the deposit, of which at least selected pre-blast locations of said spaced pre-blast locations carry respective markers that are such that the post-blast locations of at least a useful proportion will be detectable after explosion of the charges;
- exploding the explosive charges to fragment the deposit; and
- detecting the post-blast locations of certain of said markers after the exploding of charges to obtain an indication of the relative positions of selected components of the mineral deposit after the fragmentation of the deposit by the exploding of the charges.

Preferably, at the selected respective pre-blast locations, the explosive charges and the markers are in common blast holes. In one possible such arrangement, the markers are combined with or incorporated in the explosive charges.

In many embodiments, said useful proportion of the markers comprise said certain markers and are positively detectable after the explosion.

In many embodiments, said useful proportion of the markers comprises said certain markers and are positively detectable after the explosion. In other embodiments, the location of markers may be detected by their absence.

The markers may be active, in the sense that they are configured to automatically emit a signal for at least a prescribed time after explosion of the charges, or passive in the sense that they require an external stimulus such as irradiation for activation. Markers in the latter category may include a luminescent marker in an amount sufficient to be non-destructively optically detectable after the fragmentation of the deposit by the exploding of the charges. Particularly where the markers are combined with or incorporated in the explosive charges, the markers should be such as to not materially affect the performance of the charges when they are exploded to fragment the deposit. In part for this reason, and in part for more general economic reasons, the marker is preferably present in a trace amount.

Markers may be alternative materials to luminescent markers that survive the exploding of the charges.

In another implementation, the markers may be radiating sources of energy and in particular a source of seismic energy and/or acoustic energy or electromagnetic energy. Sufficiently robust electromagnetic beacons, either active or passive, may be employed.

In the implementation of markers as a radiating source of seismic and/or acoustic energy, the marker may actually be a secondary explosive charge that like other implementations moves with the ore/waste boundary but in this case the markers are destroyed but in the process of their destruction emit energy that may be used to locate their positions. Alternatively, the markers as energy sources may be radiating energy continuously throughout the rock mass that is to be fragmented until impacted by the blast energy and the extinguishment of those charges along the boundary may be identified after the fragmentation of the rock mass. In the last approach, the rock mass to be fragmented is marked throughout its complete extent the location of the boundary is identified by detecting the location of markers by their absence.

By 'trace amount' is meant an amount between one part per billion and 1% by mass of the associated explosive charge. Alternatively, 'trace amount' indicates an amount which is not detectable to observation by the naked eye. In certain implementations, the markers may be deployed in large number despite their trace quantity or deployed in small number not directly related to their ratio with either the quantity of explosives or the volume of rock mass fragmented.

The term 'luminescent marker' includes markers comprising a material or mixture of materials that display fluorescence or phosphorescence on appropriate irradiation. Typically, for example, the luminescent marker may provide a unique and readily detectable luminescent response on irradiation with appropriate electromagnetic radiation. A range of luminescent markers that may be suitable for the present application is set out in international patent publication WO 2006/119561.

Only those luminescent markers for which at least a useful proportion will survive explosion of the plurality of the charges will be applicable to the present invention. It will be appreciated that, in an optimum case, most or all of the markers will survive the explosion, but practical embodiments of the invention might involve an acceptance that not all of the markers will survive sufficiently to be detectable but that the proportion of them that survive a coordinated explosion of a multiplicity of charges is sufficient to thereafter allow the desired indication of the relative positions of the selected components of the fragmented mineral deposit.

Preferably, it is the boundaries between the selected components of the mineral deposit that are desired to be identified and to this end the markers are selectively placed at pre-blast explosive charge locations that are at or proximate to the known boundaries between the components prior to the explosion of the charges.

Components of the mineral deposit of interest post-fragmentation may typically be components respectively containing and not containing the valuable mineral of interest, i.e. components classified as ore and waste.

A second aspect of the invention proposes post-blast mapping of the locations of markers in a fragmented deposit, in contrast to the known practice of merely using detectors walked over the fragmented deposit to find and locate individual markers post-blast. Such mapping may occur in real-time so that immediated feedback may be given to the survey and excavation processes of the mine for the purpose to which this invention applies.

Accordingly, in its second aspect, the invention provides a method of mining a mineral deposit, including:

setting, at a first set of spaced pre-blast locations in the deposit, a plurality of explosive charges suitable for fragmenting the deposit on being collectively exploded;

setting, at a second set of spaced locations in the deposit, a plurality of markers arranged to emit a detectable signal after said fragmentation;

exploding the explosive charges to fragment the deposit; and detecting the post-blast locations of certain of said markers after the exploding of the primary explosive charges, by triangulation techniques employing a plurality of receiver detectors that receive said detectable signals, and mapping their post-blast locations in the fragmented deposit, whereby to facilitate at least partial characterisation of the relative positions of respective components of the deposit.

Preferably, said detection and mapping is carried out with a plurality of receiver detectors deployed locally and in a roving fashion or globally and in fixed fashion.

The markers may be active, in the sense that they are configured to automatically emit a signal for at least a prescribed time after explosion of the charges, or passive in the sense that they require an external stimulus such as irradiation for activation. Markers in the latter category may include the luminescent markers preferred for the first aspect of the invention, and to this extent the above discussion concerning such luminescent markers applies equally to the second aspect of the invention.

Sufficiently robust electromagnetic beacons, either active or passive may be employed. It has been found that the detection range for such beacons is greater in fragmented rock post-blast, because of the air incursions into the muck pile.

In an application of the second aspect of the invention, the first and second sets of spaced locations are at least partially coincident and the method of mining is also in accordance with the first aspect of the invention.

An embodiment of active markers would comprise a plurality of secondary explosive charges suitable to be acoustically and/or seismically detectable on being activated. In this embodiment, the method would include, after the step of exploding the (primary) explosive charges to fragment the deposit, shortly thereafter activating the secondary explosives charges, and mapping the locations of the secondary explosive charges by acoustically and/or seismically detecting their explosion.

In an embodiment, at least one of the receiver detectors may be a portable unit adapted to be carried about the fragmented mineral deposit. In other applications, the mapping may be carried out remotely, for example from an aircraft.

More generally, in relation to the afore-mentioned use of secondary explosive charges, the invention in a third aspect provides a method of mining a mineral deposit, including:

setting, at a first set of spaced pre-blast locations in the deposit, a plurality of primary explosive charges suitable for fragmenting the deposit on being collectively exploded;

setting, at a second set of spaced pre-blast locations in the deposit, a plurality of secondary explosive charges, suitable to be acoustically and/or seismically detectable on being activated;

exploding the primary explosive charges to fragment the deposit;

shortly thereafter activating the secondary explosive charges; and detecting the post-blast locations of the secondary explosive charges by acoustically and/or seismically detecting their response to activation.

Advantageously, the method may further include mapping the post-blast locations of the secondary explosive charges in the fragmented deposit, whereby to facilitate at least partial characterisation of the relative positions of respective components of the deposit.

In an embodiment, the secondary explosive charges are electronic delay detonators, possibly with booster charges and/or further explosive charge, arranged to fire at least some milliseconds or seconds after the main blast has settled.

It is preferred that, in both the second aspect of the invention and in the preferred third aspect, the mapping of the post-blast locations of the markers in the fragmented deposit is done in real time, for which multiple receiver detectors are necessary. In the case of the third aspect of the invention, it would be typical that the plurality of secondary explosive charges would be activated sequentially and so the configuration of receiver detectors (which may typically be, for example, an array of microphones, geophones and/or accelerometers) must be such as to a sufficient of their number detect the responses of the secondary explosive charges to activation.

The difference in arrival times of the ground or air vibrations respectively from the markers may be used to estimate the location of the marker source by triangulation techniques.

An identical approach to active sources that radiate seismic and/or acoustic energy may be implemented whereby the active sources radiate electromagnetic energy or other form of detectable energy and an array of receiver antennae are deployed remote from the blast.

In any of the active, radiating sources of energy implementations, it is possible that the array of receivers may reside within the rock mass to be fragmented or external to it. In the case when the array of receivers reside within the rock mass to be fragmented a plurality of them need to survive for sufficient time to indicate their reception of the radiated energy and such confirmation of energy reception may be transmitted through a formal network or ad-hoc network composed of the surviving receivers so that the final location of the active markers are identified by proximity, signal strength and/or triangulation.

In general, in relation to triangulation methods with active markers, the inversion of the travel time data received at an array of detectors from each target that successfully emits a signal (e.g. seismic, acoustic or electromagnetic) may use various algorithms. At their core many such algorithms rely on minimisation of the difference between the actual measured data and the predicted data using a least squares approach. For example, a modified Levenberg-Marquardt algorithm has proven to be robust in the presence of noisy measured signals, particularly when inversion does not involve an estimation of the assumed uniform velocity of the propagating signals. Alternative optimisation techniques that employ a priori information may be used, particularly if the transmitting medium has known anisotropy (eg rock strata with different mechanical or electromagnetic properties). The inversion methods require a minimum number of independent detectors in order to estimate the three dimensional coordinates of any single target and/or the medium velocity.

Experiments have established that for active markers of radiated seismic/acoustic energy, the most accurate locations are obtained when the velocity of the seismic and/or acoustic waves is assumed, rather than when it is estimated from the measured data. Using cross correlation of the received waveforms aids in the estimation of travel times and arrival times. Marker locations were more accurate with the acoustic data than with the seismic data, due apparently to the greater variability of the seismic velocity compared to the acoustic velocity. Of several source/marker location algorithms tested, the aforementioned modified Levenberg-Marquardt method produced the most consistent results. It was also found that accurate data for receiver locations was important, and that reliable mapping is also dependent upon a minimum level of error in time differences. Where appropriate and accessible, GPS technology and synchronised clocks may be employed to accurately obtain travel time differences and thereby to estimate accurate source locations and seismic/acoustic velocities.

In an embodiment of the second or third aspect of the invention, at least one of the receiver detectors is fitted to earth-moving equipment being employed to recover successive portions of the fragmented deposit. More generally, in a fourth aspect of the invention, earth-moving equipment being employed to recover successive portions of an explosively fragmented mineral deposit are fitted with means to detect surviving markers so as to give the operator of the equipment real-time knowledge about the portions recovered or to be recovered.

In its fourth aspect, the invention provides a method of mining a mineral deposit, including:

setting, at a first set of spaced pre-blast locations in the deposit, a plurality of explosive charges suitable for fragmenting the deposit on being collectively exploded;

setting, at a second set of spaced pre-blast locations in the deposit, a plurality of markers of which the post-blast location of at least a proportion will be detectable after said fragmentation;

exploding the primary explosive charges to fragment the deposit; and recovering successive portions of the fragmented deposit with earth-moving equipment fitted with means to detect the post-blast location of certain markers, thereby to facilitate at least partial characterisation of the respective portions being or to be recovered.

Advantageously, in the fourth aspect of the invention, the first and second sets of spaced locations are at least in part coincident, whereby detection of the surviving markers may be in accordance with the first aspect of the invention. In general; any of the preferred, advantageous and optional aspects of the first, second and third aspects of the invention also apply where relevant to the fourth aspect.

Markers that may be employed in the various aspects of the invention according to suitability include locally coloured material such as coloured sand or concrete, electromagnetic radiation emitters (radio, visible, infra-red or ultraviolet), radioactive targets, paints or powders, RFID (Radio Frequency Identification) tags both active and passive, ultrasonic tags, security tags, radioactive tracers, quantum dots, luminescent tags subjected to suitable light, and metallic targets. It will be appreciated that the detectible energy from the markers may be electromagnetic, seismic, acoustic, radioactive or otherwise. In the second and third aspects of the invention, the receiver detectors may be an array of accelerometers, geophones or microphones.

In all aspects of the invention, detection of a marker may typically be by direct receipt of a signal from the marker. However in certain implementations, the versatility of the method may be enhanced by providing the post-blast location of a first marker by means of a signal emitted by a second marker in response to detection of a signal from the first marker that may be too weak to be received directly by the main receiver detector.

The invention claimed is:

1. A method of mining a mineral deposit, including:

setting a plurality of explosive charges at spaced pre-blast locations in the deposit, wherein at least selected pre-blast locations of said spaced pre-blast locations also carry respective markers, which markers are such that the post-blast location of at least a useful proportion will be detectable after explosion of the charges;

exploding the explosive charges to fragment the deposit; and detecting the post-blast locations of certain of said markers after the exploding of charges to obtain an indication of the relative positions of selected components of the mineral deposit after the fragmentation of the deposit by the exploding of the charges.

2. A method according to claim 1 wherein, at the respective selected pre-blast locations, the explosive charges and the markers are in common blast holes.

3. A method according to claim 2, wherein the markers in the common blast holes are combined with or incorporated in the explosive charges.

4. A method according to claim 1 wherein said useful proportion of the markers comprise said certain markers and these markers are positively detectable after the explosion.

5. A method according to claim 1 wherein said markers are active markers.

6. A method according to claim 1 wherein said markers are passive markers.

7. A method according to claim 1 wherein said markers are arranged to emit a signal detectable after exploding of the charges, and the method includes detecting the location of the markers by triangulation techniques employing a plurality of receiver detectors that receive said detectable signals.

8. A method according to claim 1 wherein said markers are arranged to emit an electromagnetic signal.

9. A method according to claim 1 wherein each said marker comprises a luminescent marker in an amount sufficient to be non-destructively optically detectable after the fragmentation of the deposit by the exploding of the charges.

10. A method according to claim 9 wherein the luminescent marker is present in a trace amount.

11. A method according to claim 1 wherein said explosive charges are primary explosive charges and said markers comprise secondary explosive charges detectable acoustically and or seismically on being actuated, and wherein the method includes, after the step of exploding the explosive charges to fragment the deposit, shortly thereafter activating the secondary explosive charges, and mapping the locations of the secondary explosive charges by acoustically and/or seismically detecting their explosion.

12. A method according to claim 1 wherein said useful proportion of the markers are detectable after the explosion by their absence.

13. A method according to claim 1 wherein the markers are selectively placed at pre-blast explosive charge locations that are at or proximate to the known boundaries between said components of the mineral deposit prior to the explosion of the charges.

14. A method according to claim 1 wherein said detecting is carried out with a plurality of receiver detectors deployed locally and in a roving fashion.

15. A method according to claim 1 wherein said detecting is carried out with a plurality of receiver detectors deployed globally and in fixed fashion.

16. A method according to claim 15 wherein at least one of the receiver detectors is fitted to earth-moving equipment being employed to recover successive portions of the fragmented deposit.

17. A method according to claim 7 wherein, at the respective selected pre-blast locations, the explosive charges and the markers are in common blast holes.

18. A method according to claim 17 wherein the markers in the common blast holes are combined with or incorporated in the explosive charges.

19. A method according to claim 9 wherein, at the respective selected pre-blast locations, the explosive charges and the markers are in common blast holes.

20. A method according to claim 19 wherein the markers in the common blast holes are combined with or incorporated in the explosive charges.

21. A method according to claim 9 wherein said markers are arranged to emit a signal detectable after exploding of the charges, and the method includes detecting the location of the markers by triangulation techniques employing a plurality of receiver detectors that receive said detectable signals.

22. A method according to claim 11 wherein, at the respective selected pre-blast locations, the explosive charges and the markers are in common blast holes.

23. A method according to claim 22 wherein the markers in the common blast holes are combined with or incorporated in the explosive charges.

24. A method according to claim 11 wherein said markers are arranged to emit a signal detectable after exploding of the charges, and the method includes detecting the location of the markers by triangulation techniques employing a plurality of receiver detectors that receive said detectable signals.

* * * * *